US009551969B2

(12) United States Patent
Atwood

(10) Patent No.: US 9,551,969 B2
(45) Date of Patent: Jan. 24, 2017

(54) DESKEW MECHANISM WITH LINEAR MOTION

(71) Applicant: XEROX CORPORATION, Norwalk, CT (US)

(72) Inventor: Mark A. Atwood, Rush, NY (US)

(73) Assignee: Xerox Corporation, Norwalk, CT (US)

( * ) Notice: Subject to any disclaimer, the term of this patent is extended or adjusted under 35 U.S.C. 154(b) by 290 days.

(21) Appl. No.: 14/306,780

(22) Filed: Jun. 17, 2014

(65) Prior Publication Data

US 2015/0362882 A1 Dec. 17, 2015

(51) Int. Cl.
*G03G 15/00* (2006.01)

(52) U.S. Cl.
CPC .. *G03G 15/5041* (2013.01); *G03G 2215/0135* (2013.01); *G03G 2215/0161* (2013.01)

(58) Field of Classification Search
CPC ..... G03G 15/5041; G03G 2215/0135; G03G 2215/0161
See application file for complete search history.

(56) References Cited

U.S. PATENT DOCUMENTS

| | | | | |
|---|---|---|---|---|
| 5,633,744 | A | 5/1997 | Nakajima | |
| 5,946,111 | A * | 8/1999 | Bock | B41J 2/473 358/474 |
| 6,600,504 | B2 * | 7/2003 | Okugawa | B41J 2/471 347/152 |
| 7,760,226 | B2 | 7/2010 | Atwood et al. | |
| 8,004,551 | B2 * | 8/2011 | Atwood | H04N 1/032 347/242 |
| 8,073,378 | B2 * | 12/2011 | Calamita | G03G 15/75 347/116 |

* cited by examiner

*Primary Examiner* — Bradley Thies
(74) *Attorney, Agent, or Firm* — Gibb & Riley, LLC

(57) ABSTRACT

An apparatus comprises a bracket connected to a frame, where the bracket connects a light source to the frame. The frame supports a photoreceptor that has a planar surface. Also, the bracket positions the light source at a set distance from the photoreceptor. Further, the bracket comprises an adjustment device that moves the light source along a plane that is parallel to the planar surface of the photoreceptor, and that maintains the light source at the set distance from the photoreceptor as the light source moves within the plane.

17 Claims, 8 Drawing Sheets

DESKEW MECHANISM WITH LINEAR MOTION

BACKGROUND

Systems and methods herein generally relate to imaging devices within printers, and more particularly to adjustment devices that correct the skew of the imaging devices to provide proper alignment between all colors.

Modern printing devices utilize optical imaging devices (such as raster output scanners (ROSs)) to pattern an existing charge on a charged surface (such as a uniformly charged photoreceptor drum or belt). This patterned charge is sometimes referred to as a "latent image." Once the imaging devices pattern the charges on the surface of the photoreceptor, marking material (such as toners, inks, etc.) is developed (transferred) onto the photoreceptor in the pattern matching the latent image on the photoreceptor. Different imaging devices are utilized to create a different latent image for each color marking material. Therefore, each of the imaging devices should be similarly aligned with the photoreceptor in order to produce high quality prints. If one or more of the imaging devices is skewed or misaligned relative to the other imaging devices, the colors that are printed onto the printed media will be similarly misaligned, resulting in a low quality printed item.

Sensors serve to detect the misregistration or misalignment between colors. Each imaging device can have its own motor, allowing each imaging device to be independently skewed for image alignment. For example, before or during printing, alignment processes can place registration images side by side on the belt, and the sensors indicate how much each ROS needs to be skewed to provide the optimum color-to-color registration deposited on the belt.

SUMMARY

Started broadly, an exemplary apparatus herein comprises a bracket connected to a frame, where the bracket connects a light source to the frame. The frame supports a photoreceptor that has a planar surface. Also, the bracket positions the light source at a set distance from the photoreceptor. Further, the bracket comprises an adjustment device that moves the light source along a plane that is parallel to the planar surface of the photoreceptor, and that maintains the light source at the set distance from the photoreceptor as the light source moves within the plane.

Another apparatus herein comprises a frame, rollers connected to the frame, a continuous photoreceptor belt contacting the rollers, a bracket connected to the frame, and an elongated light source (e.g., a laser device, an incandescent light device, a light emitting diode (LED) device, etc.) connected to the bracket. The photoreceptor belt has a planar surface and the elongated light source extends across the width of the planar surface of the photoreceptor belt.

The bracket positions the light source at a focal distance from the photoreceptor belt. The bracket comprises an adjustment device (e.g., a powered actuator, a manually operated screw adjuster, etc.) moving the light source along a plane parallel to the planar surface, and the adjustment device maintains the light source at the same focal distance from the photoreceptor belt as the light source moves within the plane (when being moved by the adjustment device). The photoreceptor belt moves in a belt movement direction relative to the elongated light source when the rollers move the photoreceptor belt. The belt movement direction is parallel to the centerline and opposing ends/edges of the continuous photoreceptor belt. The adjustment device adjusts the skew of the elongated light source relative to this belt movement direction (e.g., relative to the centerline of the photoreceptor belt). Thus, the adjustment device adjusts the skew of the elongated light source relative to the belt movement direction without altering the focal distance.

More specifically, the elongated light source has opposing ends positioned at opposing edges of the width of the photoreceptor belt. The bracket comprises a first connector maintaining a first end of the opposing ends of the elongated light source in a fixed position. The adjustment device is connected to an opposite end (e.g., second end) of the opposing ends of the elongated light source. The first end of the elongated light source rotates around the first connector as the adjustment device moves the second end of the elongated light source within the plane that is parallel to the planar surface of the photoreceptor belt (as the adjustment device adjusts the skew of the elongated light source relative to the belt movement direction). A second adjustment device moves the elongated light source along a second plane (perpendicular to the planar surface of the photoreceptor belt) to alter the focal distance.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

Figure 1:
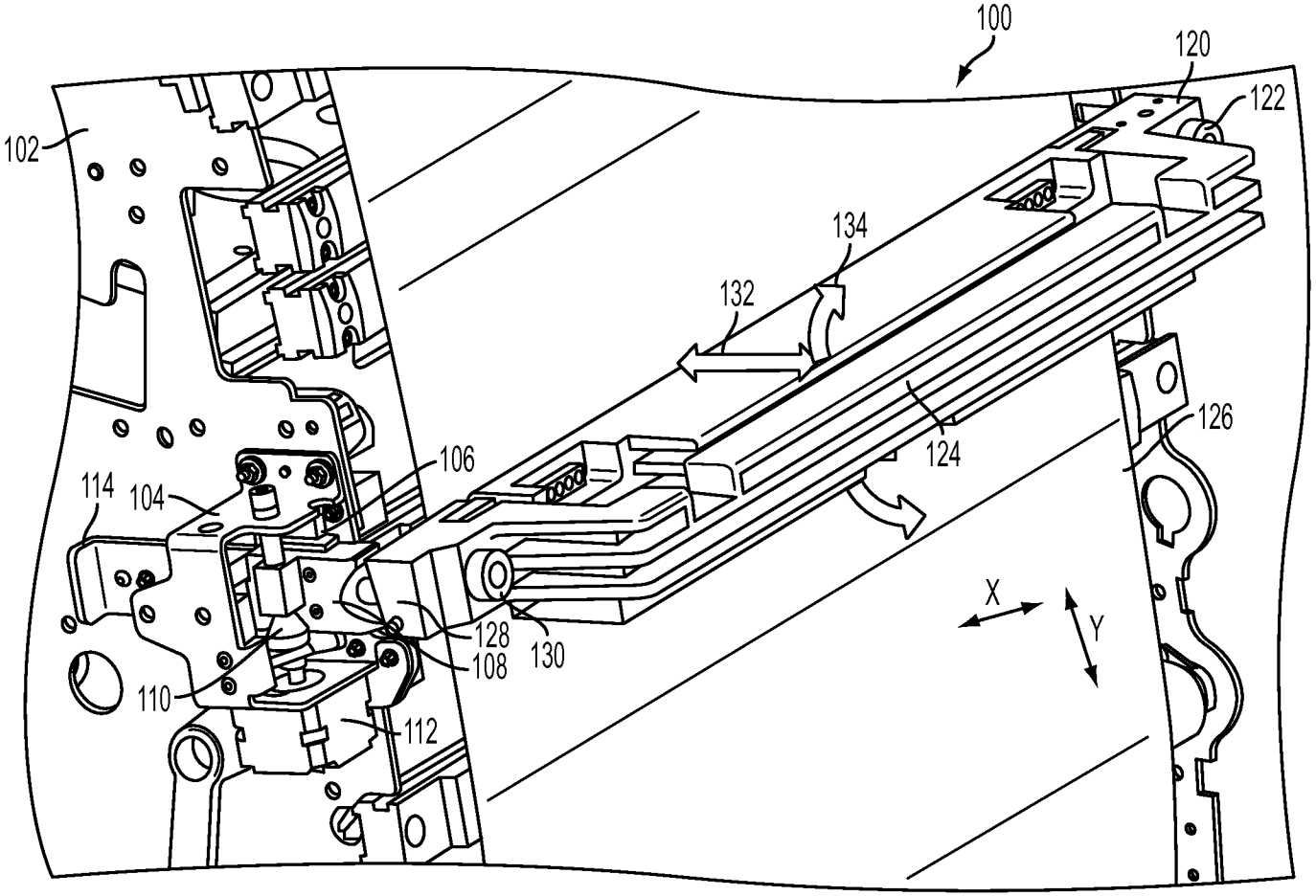
FIG. 1 is a schematic diagram illustrating devices herein.

As mentioned above, to promote high-quality printing, color-to-color skew can be addressed by aligning the imagers (ROS); however, deskewing the imagers can unintentionally change the imager's focal point with respect to the photoreceptor (PR) belt. This is especially true for imagers that use light emitting diodes (LEDs) because LEDs have a much tighter focus tolerance than comparable lighting systems. In view of this, devices herein maintain imager focus throughout the deskew procedure by causing the imager to travel parallel to the photoreceptor belt plane.

FIGS. 1-8 illustrate the deskew apparatus structure 100 herein from different angles. In each of these drawings, the structure is shown to include a frame 102, rollers (shown in FIGS. 10 and 11 as item 252) connected to the frame 102, a continuous photoreceptor belt 126 contacting the rollers 252 (and being supported by, and driven by the rollers 252), a bracket 104, 114 connected to the frame 102, and an elongated imaging device 124 (e.g., an imaging device (raster output scanner (ROS)) such as a laser device, an incandescent light device, a light emitting diode (LED) device, etc.) connected to the bracket 104, 114.

While the elongated imaging device 124 can be any device that produces any form of light (inside or outside the visible spectrum); however, because of the sensitivity to focal distance of LEDs, the structures herein are especially useful for LEDs because structures herein maintain precise control over focal distance. The photoreceptor belt 126 has a planar surface and the elongated imaging device 124 extends across the width of the planar surface of the photoreceptor belt 126, as shown in FIG. 1, for example.

For ease of reference, in the drawings, direction Y is the direction in which the photoreceptor belt 126 moves when driven by the rollers 252. The width of the planar surface of the photoreceptor belt 126 is perpendicular to direction Y. Additionally, direction X is a direction toward or away from the planar surface of the photoreceptor belt 126. Therefore, direction X is perpendicular to direction Y and to the width of the photoreceptor belt 126. Additionally, the ends of the imaging device 124 have been labeled: item 120 (which, for convenience, is referred to as a first end or inboard end); and item 128 (which, for convenience, is referred to as a second end or outboard end). The inboard end 120 is fixed in position with respect to the frame 102 by a connector 122, and the inboard end 120 is free to rotate around the connector 122 as indicated by arrows 134. The outboard end 128 is connected by a connector 130 that includes a rounded protrusion that fits within a V-block 108. As discussed in greater detail below, the V-block 108 is moved in direction Y by adjustment device 110, 112; and this also causes the imaging device 124 to move in an arc as indicated by arrows 134. Arrow 132 represents a focus adjustment, as discussed in detail below.

Therefore, as noted above, the photoreceptor belt 126 moves in a belt movement direction Y relative to the elongated imaging device 124 when the rollers move the photoreceptor belt 126. The belt movement direction Y is parallel to the photoreceptor belt centerline and to opposing ends/edges of the continuous photoreceptor belt 126. The adjustment device 110 adjusts the skew 134 of the elongated imaging device 124 relative to this belt movement direction Y (e.g., relative to the centerline of the photoreceptor belt 126). Thus, the adjustment device 110 adjusts the skew 134 of the elongated imaging device 124 relative to the belt 126 movement direction Y without moving the imaging device 124 in the focal direction 132 and, therefore, without altering the focal distance 140.

More specifically, the elongated imaging device 124 has opposing ends 120, 128 positioned at opposing edges of the width of the photoreceptor belt 126. The bracket 104, 114 comprises a first connector 122 maintaining a first end 120 of the opposing ends of the elongated imaging device 124 in a fixed position. The adjustment device 110 is connected to an opposite end (e.g., second end) 128 of the opposing ends of the elongated imaging device 124. The first end 120 of the opposing ends of the elongated imaging device 124 rotates around the first connector 122 as the adjustment device 110 moves the second end 128 of the opposing ends of the elongated imaging device 124 within the plane that is parallel to the planar surface of the photoreceptor belt 126 (as the adjustment device 110 adjusts the skew 134 of the elongated imaging device 124 relative to the belt 126 movement direction Y).

Figure 2:
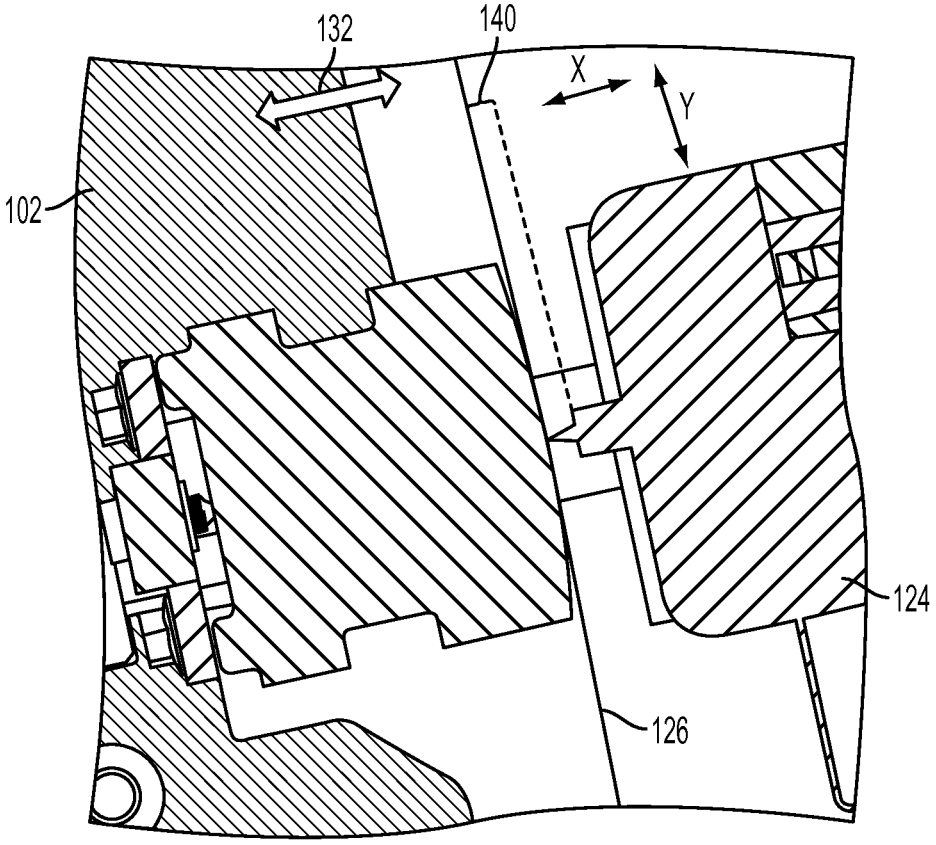
FIG. 2 is a schematic diagram illustrating devices herein.
Figure 5:
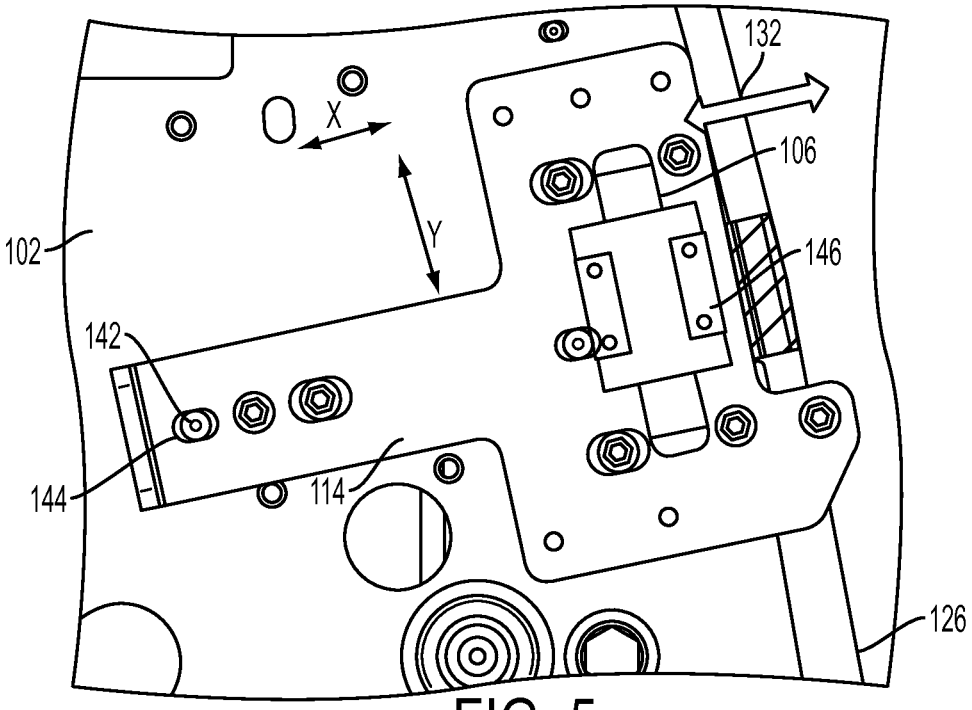
FIG. 5 is a schematic diagram illustrating devices herein.

FIG. 2 is a sectional view of the structure shown in FIG. 1 and illustrates that the imaging device 124 is at a focal distance 140 from the photoreceptor belt 126 (and this focal distance 140 is maintained by bracket 104, 114). Note that in FIG. 2, the focal distance 140 is in direction X and, consistent with FIG. 1, the focus adjustment direction is shown as item 132. As shown in FIG. 5, a portion of the bracket 114 moves in the direction X to provide a second adjustment device that moves the elongated imaging device 124 along a second plane that is perpendicular to the planar surface of the photoreceptor belt 126 to alter the focal distance 140. This second plane is parallel to the direction X. The movement of bracket 114 in direction X can be performed manually or can be automated using an actuator.

Figure 3:
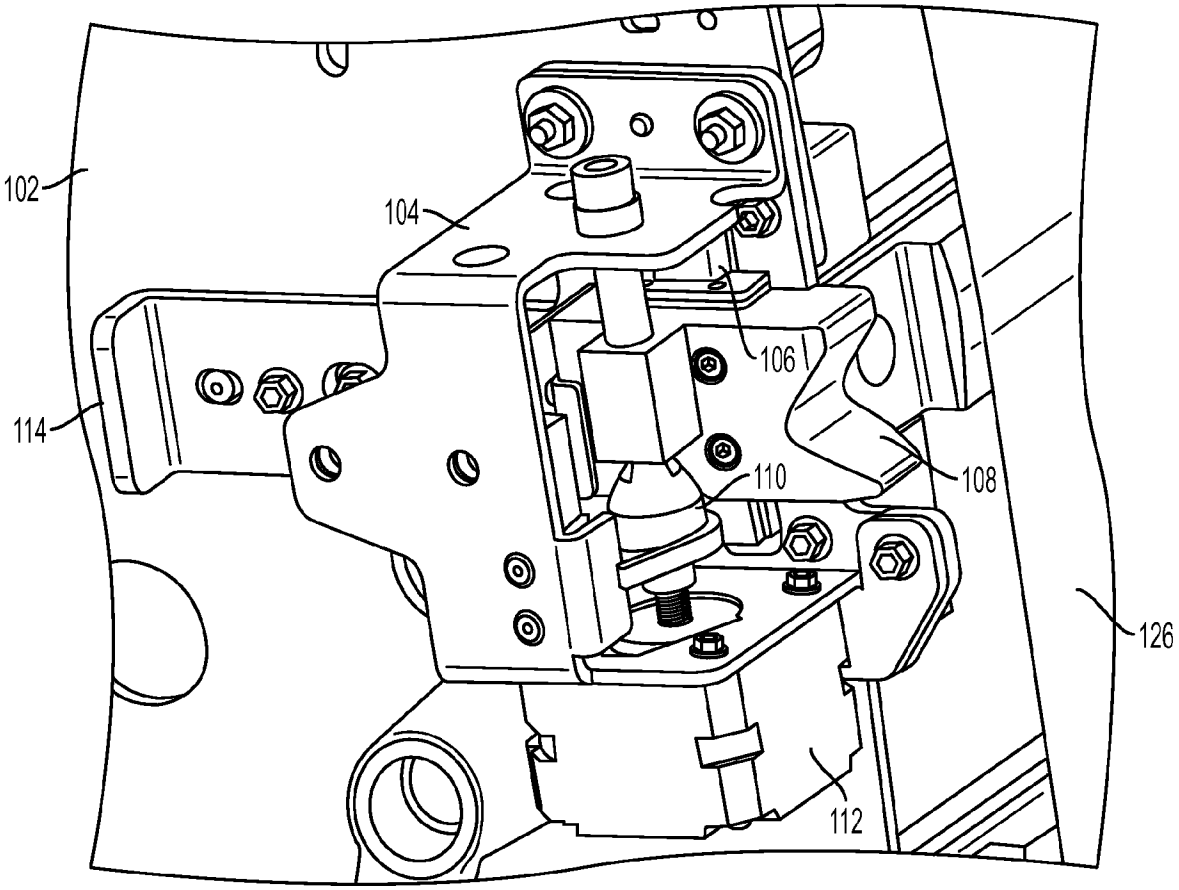
FIG. 3 is a schematic diagram illustrating devices herein.

FIG. 3 is a more detailed view of the structure shown in FIG. 1 and illustrates that the bracket 104, 114 comprises an adjustment device 110 (e.g., a powered actuator 112, a potentially manually operated screw adjuster 110, etc.) moving the imaging device 124 along a plane parallel to the planar surface. The plane in which the imaging device 124 moves is parallel to direction Y and is perpendicular to direction X. The adjustment device 110 maintains the imaging device 124 at the same focal distance 140 from the photoreceptor belt 126 as the imaging device 124 moves within the plane that is parallel to the photoreceptor 126 (when being moved by the adjustment device 110).

Additionally, FIG. 3 illustrates that the V-block 108 moves along a slide 106 as the actuator 112 moves the screw adjuster 110 (which can include a conical cover as shown in the drawings). As shown in FIG. 1, the sphere shape of connector 130 is captured in the V-block 108. Further, as noted above, the V-block 108 translates on the linear slide 106 that travels parallel to the photoreceptor belt plane. The actuator 112 that drives the V-block 108 along the slide 106 can be, for example, a stepper motor 112 with lead screw arrangement 110 that provides micron resolution.

Figure 4:
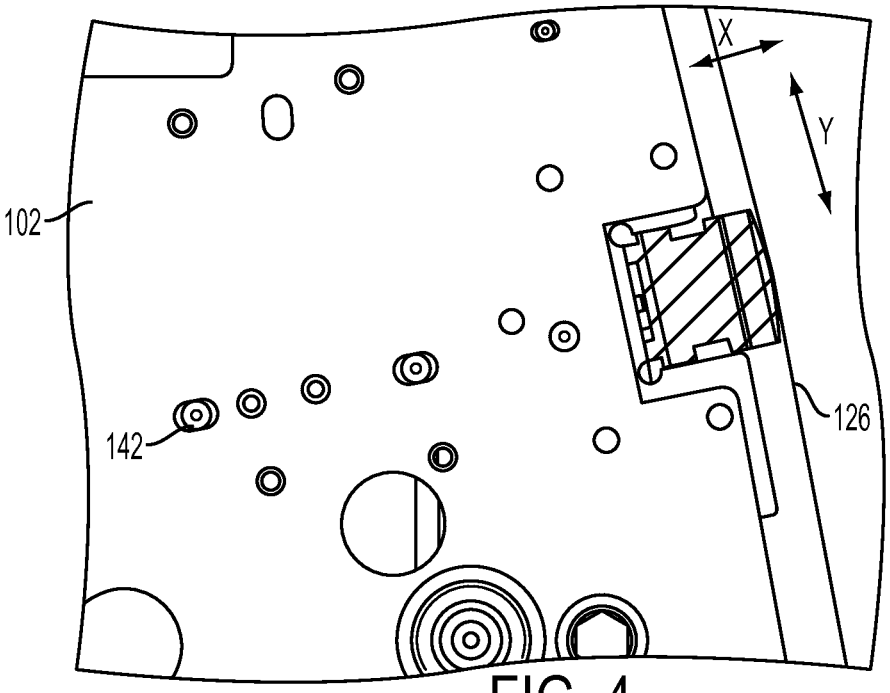
FIG. 4 is a schematic diagram illustrating devices herein.

FIG. 4 illustrates dowels 142 that protrude through the frame 102. In FIG. 5, one portion of the bracket 114 includes slots 144 into which the dowels 142 are positioned. As shown in FIG. 5, by moving a portion of the bracket 114 in direction X (the "setting focus" direction) the dowels 142 move within the slots 144 so as to adjust the focal length 140 in the focus direction 132. Additionally, FIG. 5 illustrates a plate 146 that rides upon the linear slide 106. The V-block 108 connects to the plate 146 and both slide together over the linear slide 106 when the actuator 112 rotates the screw adjuster 110.

Figure 6:
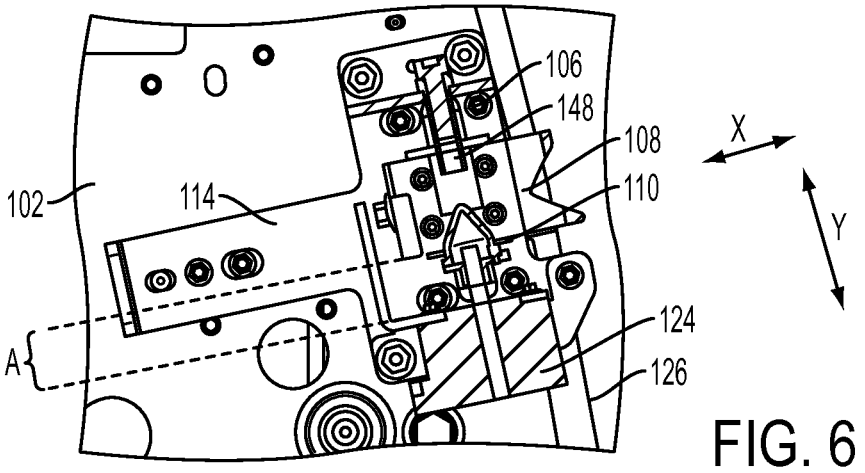
FIG. 6 is a schematic diagram illustrating devices herein.
Figure 7:
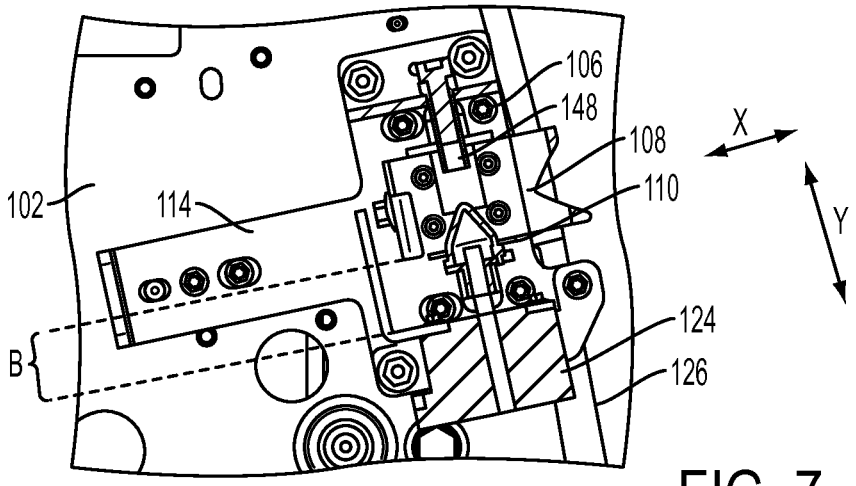
FIG. 7 is a schematic diagram illustrating devices herein.
Figure 8:
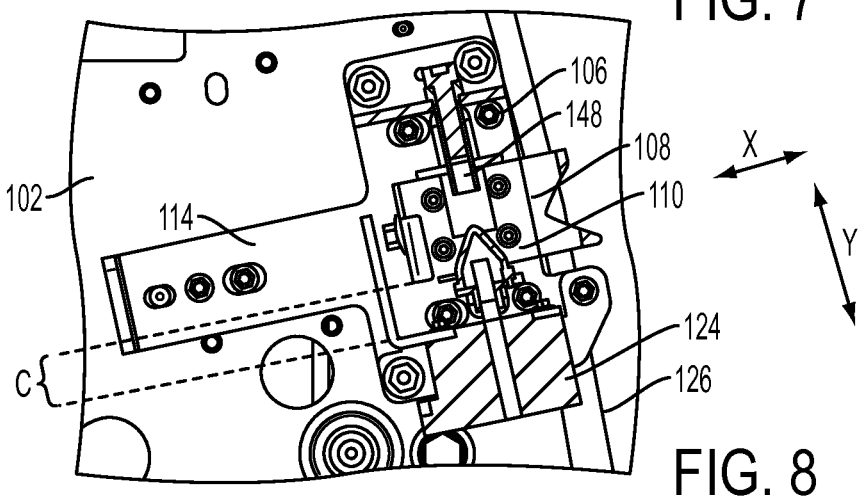
FIG. 8 is a schematic diagram illustrating devices herein.

FIGS. 6-8 illustrate the V-block 108 at different positions (A, B, C) relative to the actuator 112 to illustrate the deskewing that takes place by driving the V-block 108 along the slide 106 using the stepper motor 112 and screw adjuster 110. The screw adjuster 110 has the conical feature that mates with a conical depression feature in the V-block 108. More specifically, the actuator 112 turns the screw adjuster 110 to move the V-block 108 from distance A (shown in FIG. 6) to a greater distance B (shown in FIG. 7) relative to the actuator 112. Opposite rotation of the screw adjuster 110 by the actuator 112 moves the V-block 108 closer to the actuator 112 as shown by distance C in FIG. 8. The cone is held stationary while the rotation moves the lead screw 110 in direction Y. A compression spring 148 is located opposite the cone to provide a bias force to always maintain contact between the cone and the V-block 108. Closed loop controls allow the system to dynamically correct image registration as required.

Figure 9:
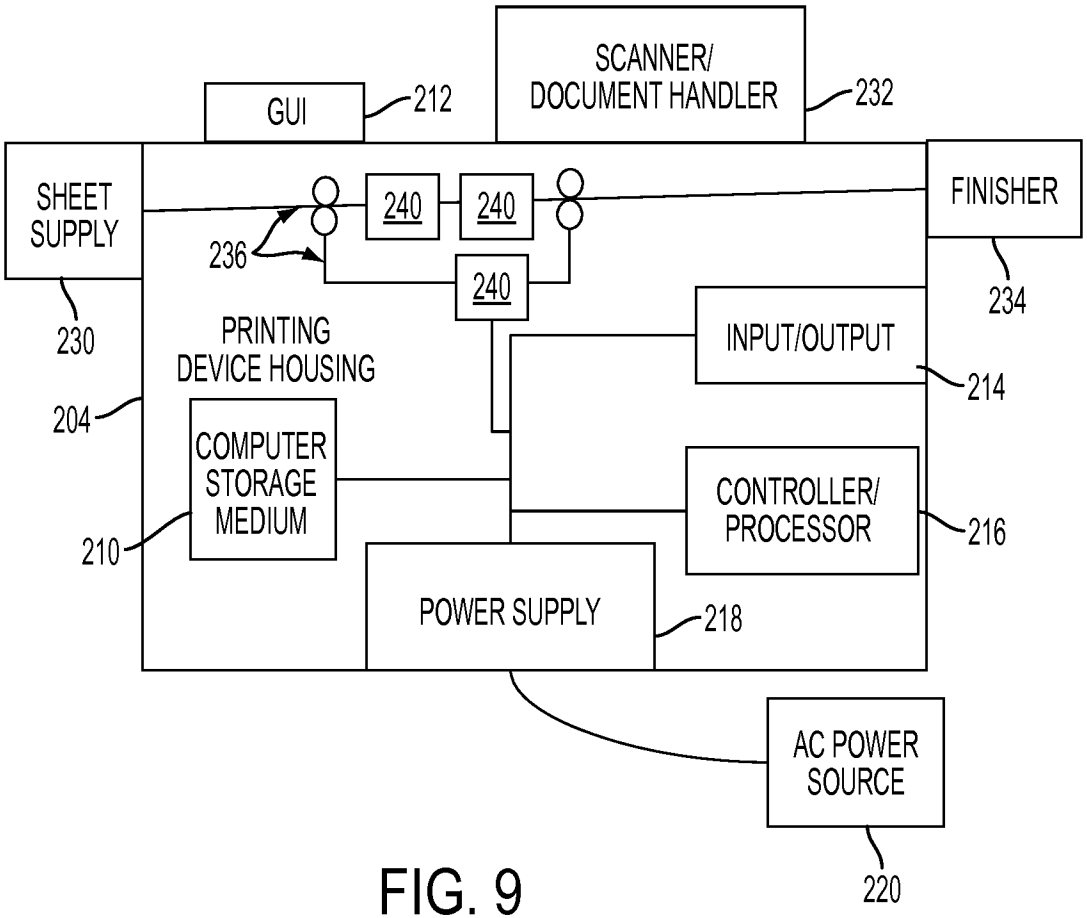
FIG. 9 is a schematic diagram illustrating systems herein.

FIG. 9 illustrates a computerized device that is a printing device 204, which can be used with systems and methods herein and can comprise, for example, a printer, copier, multi-function machine, multi-function device (MFD), etc. The printing device 204 includes a controller/tangible processor 216 and a communications port (input/output) 214 operatively connected to the tangible processor 216 and to the computerized network 202 external to the printing device 204. Also, the printing device 204 can include at least one accessory functional component, such as a graphical user interface (GUI) assembly 212 that also operate on the power supplied from the external power source 220 (through the power supply 218). The user may receive messages, instructions, and menu options from, and enter instructions through, the graphical user interface or control panel 212.

The input/output device 214 is used for communications to and from the printing device 204 and comprises a wired device or wireless device (of any form, whether currently known or developed in the future). The tangible processor 216 controls the various actions of the computerized device. A non-transitory, tangible, computer storage medium device 210 (which can be optical, magnetic, capacitor based, etc., and is different from a transitory signal) is readable by the tangible processor 216 and stores instructions that the tangible processor 216 executes to allow the computerized device to perform its various functions, such as those described herein. Thus, as shown in FIG. 9, a body housing has one or more functional components that operate on power supplied from an alternating current (AC) source 220 by the power supply 218. The power supply 218 can comprise a common power conversion unit, power storage element (e.g., a battery, etc), etc.

The printing device 204 includes at least one marking device (printing engine(s)) 240 operatively connected to the tangible processor 216, a media path 236 positioned to supply continuous media or sheets of media from a sheet supply 230 to the marking device(s) 240, etc. After receiving various markings from the printing engine(s) 240, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

Figure 10:
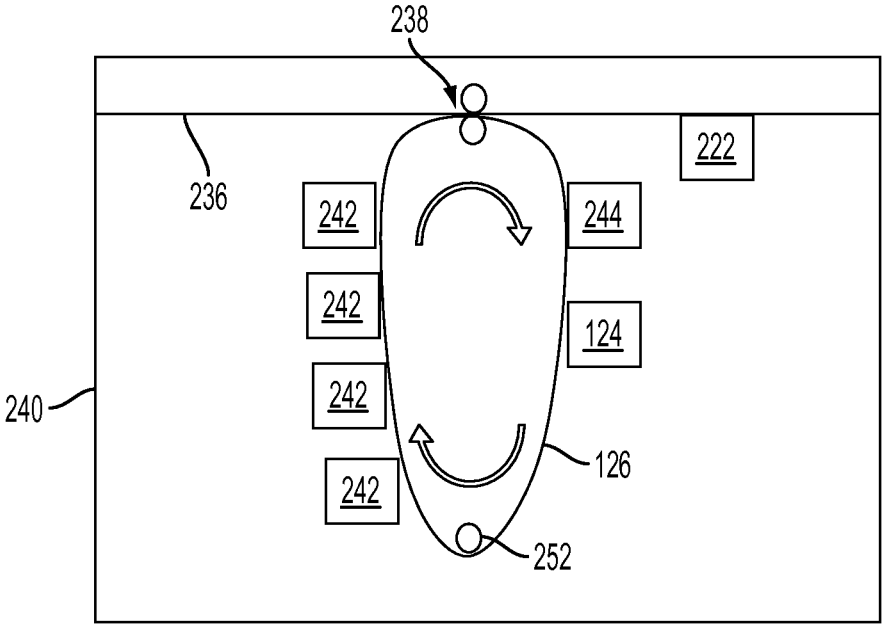
FIG. 10 is a schematic diagram illustrating systems herein.
Figure 11:
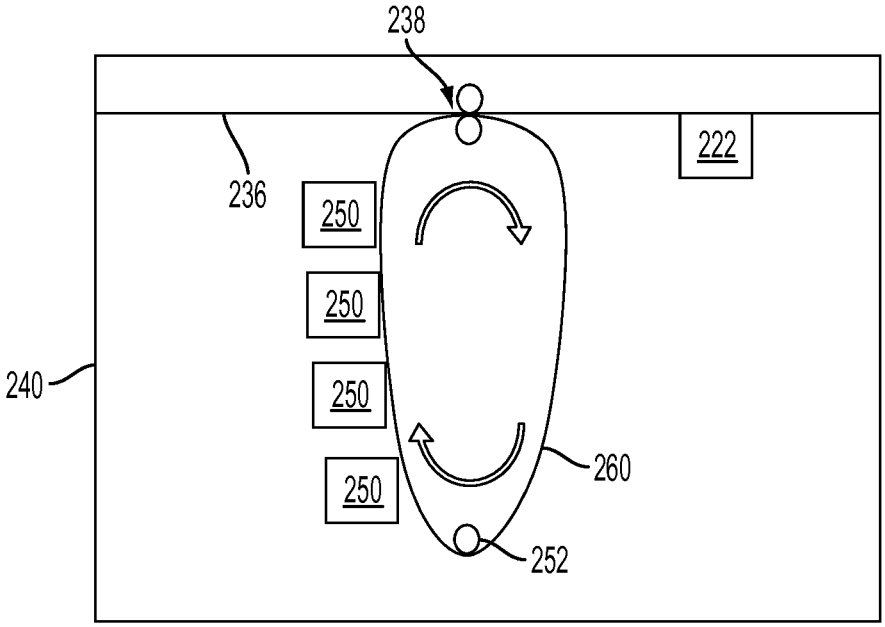
FIG. 11 is a schematic diagram illustrating devices herein.

The one or more printing engines 240 are intended to illustrate any marking device that applies a marking material (toner, inks, etc.) to continuous media or sheets of media, whether currently known or developed in the future and can include, for example, devices that use a photoreceptor belt 126 (as shown in FIG. 10) or an intermediate transfer belt 258 (as shown in FIG. 11), or devices that print directly to print media (e.g., inkjet printers, ribbon-based contact printers, etc.).

More specifically, FIG. 10 illustrates one example of the above-mentioned printing engine(s) 240 that uses one or more (potentially different color) development stations 242 adjacent a photoreceptor belt 126 supported on rollers 252. Thus, in FIG. 10 an electronic or optical image or an image of an original document or set of documents to be reproduced may be projected or scanned onto a charged surface of the photoreceptor belt 126 using the imaging device 124 (having the deskew features discussed above) to form an electrostatic latent image. Thus, the electrostatic image can be formed onto the photoreceptor belt 126 using a blanket charging station/device 244 and the imaging station/device 124 (such as an optical projection device, e.g., raster output scanner). Thus, the imaging station/device 124 changes a uniform charge created on the photoreceptor belt 126 by the blanket charging station/device 244 to a patterned charge through light exposure, for example.

The photoreceptor belt 126 is driven (using, for example, driven rollers 252) to move the photoreceptor in the direction indicated by the arrows past the development stations 242, and a transfer station 238. Note that devices herein can include a single development station 242, or can include multiple development stations 242, each of which provides marking material (e.g., charged toner) that is attracted by the patterned charge on the photoreceptor belt 126. The same location on the photoreceptor belt 126 is rotated past the imaging station 124 multiple times to allow different charge patterns to be presented to different development stations 242, and thereby successively apply different patterns of different colors to the same location on the photoreceptor belt 126 to form a multi-color image of marking material (e.g., toner) which is then transferred to print media at the transfer station 238.

As is understood by those ordinarily skilled in the art, the transfer station 238 generally includes rollers and other transfer devices. Further, item 222 represents a fuser device that is generally known by those ordinarily skilled in the art to include heating devices and/or rollers that fuse or dry the marking material to permanently bond the marking material to the print media.

Thus, in the example shown in FIG. 10, which contains four different color development stations 242, the photoreceptor belt 126 is rotated through four revolutions in order to allow each of the development stations 242 to transfer a different color marking material (where each of the development stations 242 transfers marking material to the photoreceptor belt 126 during a different revolution). After all such revolutions, four different colors have been transferred to the same location of the photoreceptor belt, thereby forming a complete multi-color image on the photoreceptor belt, after which the complete multi-color image is transferred to print media, traveling along the media path 236, at the transfer station 238.

Alternatively, printing engine(s) 240 shown in FIG. 9 can utilize one or more potentially different color marking stations 250 and an intermediate transfer belt (ITB) 260 supported on rollers 252, as shown in FIG. 11. The marking stations 250 can be any form of marking station, whether currently known or developed in the future, such as individual electrostatic marking stations, individual inkjet stations, individual dry ink stations, etc. Each of the marking stations 250 transfers a pattern of marking material to the same location of the intermediate transfer belt 260 in sequence during a single belt rotation (potentially independently of a condition of the intermediate transfer belt 260) thereby, reducing the number of passes the intermediate transfer belt 260 must make before a full and complete image is transferred to the intermediate transfer belt 260.

Figure 12:
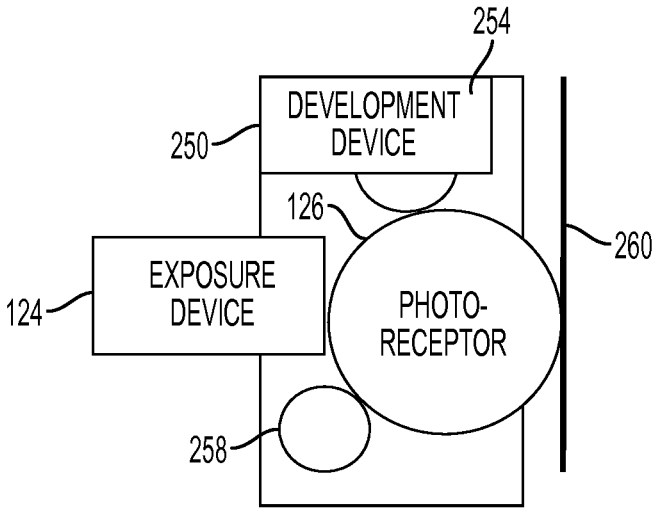
FIG. 12 is a schematic diagram illustrating devices herein.

One exemplary individual electrostatic marking station 250 is shown in FIG. 12 positioned adjacent to (or potentially in contact with) intermediate transfer belt 260. Each of the individual electrostatic marking stations 250 includes its own charging station 258 that creates a uniform charge on an internal photoreceptor 126, an internal exposure device 124 that patterns the uniform charge, and an internal development device 254 that transfers marking material to the photoreceptor 126. The pattern of marking material is then transferred from the photoreceptor 126 to the intermediate transfer belt 260 and eventually from the intermediate transfer belt to the marking material at the transfer station 238.

While FIGS. 10 and 11 illustrate four marking stations 242, 250 adjacent or in contact with a rotating belt (126, 260), which is useful with systems that mark in four different colors such as, red, green, blue (RGB), and black; or cyan, magenta, yellow, and black (CMYK), as would be understood by those ordinarily skilled in the art, such devices could use a single marking station (e.g., black) or could use any number of marking stations (e.g., 2, 3, 5, 8, 11, etc.).

Thus, in printing devices herein a latent image can be developed with developing material to form a toner image corresponding to the latent image. Then, a sheet is fed from a selected paper tray supply to a sheet transport for travel to a transfer station. There, the image is transferred to a print media material, to which it may be permanently fixed by a fusing device. The print media is then transported by the sheet output transport 236 to output trays or a multi-function finishing station 234 performing different desired actions, such as stapling, hole-punching and C or Z-folding, a modular booklet maker, etc., although those ordinarily skilled in the art would understand that the finisher/output tray 234 could comprise any functional unit.

As would be understood by those ordinarily skilled in the art, the printing device 204 shown in FIG. 9 is only one example and the systems and methods herein are equally applicable to other types of printing devices that may include fewer components or more components. For example, while a limited number of printing engines and paper paths are illustrated in FIG. 9, those ordinarily skilled in the art would understand that many more paper paths and additional printing engines could be included within any printing device used with systems and methods herein.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the systems and methods described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

Further, an image output device is any device capable of rendering the image. The set of image output devices includes digital document reproduction equipment and other copier systems as are widely known in commerce, photographic production and reproduction equipment, monitors and other displays, computer workstations and servers, including a wide variety of color marking devices, and the like. To render an image is to reduce the image data (or a signal thereof) to viewable form; store the image data to memory or a storage device for subsequent retrieval; or communicate the image data to another device. Such communication may take the form of transmitting a digital signal of the image data over a network.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. An apparatus comprising:

a bracket connected to a frame, said bracket connecting a light source to said frame, said frame supporting a photoreceptor, said photoreceptor comprising a planar surface, said bracket positioning said light source at a distance from said photoreceptor, said bracket comprising an adjustment device moving said light source along a plane parallel to said planar surface and maintaining said light source at said distance from said photoreceptor as said light source moves within said plane, said adjustment device comprising a fixed connector on said frame connected to a first end of said light source, and an adjustable connector connected to a second end of said light source, movement of said adjustable connector rotates said light source in an arc around said fixed connector, said adjustable connector comprising a slide on said bracket, a V-block connected to said slide, and an actuator connected to said V-block, said actuator moving said V-block along said slide, and said second end of said light source having a rounded protrusion contacting said V-block.

2. The apparatus according to claim 1, said photoreceptor moving in a direction relative to said light source, said adjustment device adjusting a skew of said light source relative to said direction.

3. The apparatus according to claim 2, said distance comprising a focal distance, said adjustment device adjusting said skew without altering said focal distance.

4. The apparatus according to claim 1, further comprising a second adjustment device moving said light source along a second plane perpendicular to said planar surface, said adjustment device comprising dowels within slots of said bracket, and movement of said dowels adjusts a position of said bracket on said frame.

5. The apparatus according to claim 4, said distance comprising a focal distance, said second adjustment device moving said light source to adjust said focal distance.

6. The apparatus according to claim 1, said light source comprising one of a laser device, an incandescent light device, and a light emitting diode (LED) device.

7. An apparatus comprising:

a frame;

rollers connected to said frame;

a photoreceptor contacting said rollers, said photoreceptor comprising a planar surface;

a bracket connected to said frame; and a light source connected to said bracket, said bracket positioning said light source at a distance from said photoreceptor, and said bracket comprising an adjustment device moving said light source along a plane parallel to said planar surface and maintaining said light source at said distance from said photoreceptor as said light source moves within said plane, said adjustment device comprising a fixed connector on said frame connected to a first end of said light source, and an adjustable connector connected to a second end of said light source, movement of said adjustable connector rotates said light source in an arc around said fixed connector, said adjustable connector comprising a slide on said bracket, a V-block connected to said slide, and an actuator connected to said V-block, said actuator moving said V-block along said slide, and said second end of said light source having a rounded protrusion contacting said V-block.

8. The apparatus according to claim 7, said photoreceptor moving in a direction relative to said light source, said adjustment device adjusting a skew of said light source relative to said direction.

9. The apparatus according to claim 8, said distance comprising a focal distance, said adjustment device adjusting said skew without altering said focal distance.

10. The apparatus according to claim 7, further comprising a second adjustment device moving said light source along a second plane perpendicular to said planar surface, said adjustment device comprising dowels within slots of said bracket, and movement of said dowels adjusts a position of said bracket on said frame.

11. The apparatus according to claim 10, said distance comprising a focal distance, said second adjustment device moving said light source to adjust said focal distance.

12. The apparatus according to claim 7, said light source comprising one of a laser device, an incandescent light device, and a light emitting diode (LED) device.

13. An apparatus comprising:

a frame;

rollers connected to said frame;

a photoreceptor belt contacting said rollers, said photoreceptor belt comprising a planar surface having a width;

a bracket connected to said frame; and an elongated light source connected to said bracket, said elongated light source extending across said width of said photoreceptor belt, said elongated light source comprising opposing ends positioned at opposing edges of said width of said photoreceptor belt, said bracket positioning said elongated light source at a distance from said photoreceptor belt, said bracket comprising an adjustment device moving said light source along a plane parallel to said planar surface and maintaining said light source at said distance from said photoreceptor belt as said light source moves within said plane, said bracket comprising a first connector maintaining a first end of said opposing ends of said elongated light source in a fixed position, said adjustment device being connected to a second end of said opposing ends of said elongated light source, and said first end of said opposing ends of said elongated light source rotating said elongated light source in an arc around said first connector as said adjustment device moves said second end of said opposing ends of said elongated light source in said plane, said adjustment device comprising an adjustable connector connected to said second end of said elongated light source, said adjustable connector comprising a slide on said bracket, a V-block connected to said slide, and an actuator connected to said V-block, said actuator moving said V-block along said slide, and said second end of said light source having a rounded protrusion contacting said V-block.

14. The apparatus according to claim 13, said photoreceptor belt moving in a direction relative to said elongated light source, said adjustment device adjusting a skew of said elongated light source relative to said direction.

15. The apparatus according to claim 14, said distance comprising a focal distance, said adjustment device adjusting said skew without altering said focal distance.

16. The apparatus according to claim 13, further comprising a second adjustment device moving said elongated light source along a second plane perpendicular to said planar surface, said adjustment device comprising dowels within slots of said bracket, and movement of said dowels adjusts a position of said bracket on said frame.

17. The apparatus according to claim 16, said distance comprising a focal distance, said second adjustment device moving said elongated light source to adjust said focal distance.

* * * * *